US007281637B2

(12) United States Patent
Hadar

(10) Patent No.: US 7,281,637 B2
(45) Date of Patent: Oct. 16, 2007

(54) KNOCK-DOWN CRATE WITH WALLS STORED IN BASE AND METHOD EMPLOYING SUCH A CRATE

(75) Inventor: Nir Hadar, Shefayim (IL)

(73) Assignee: Polymer Logistics (Israel) Ltd., Raanana (IL)

( * ) Notice: Subject to any disclaimer, the term of this patent is extended or adjusted under 35 U.S.C. 154(b) by 0 days.

(21) Appl. No.: 10/965,920

(22) Filed: Oct. 18, 2004

(65) Prior Publication Data

US 2005/0230392 A1 Oct. 20, 2005

Related U.S. Application Data

(63) Continuation-in-part of application No. 10/826,293, filed on Apr. 19, 2004.

(51) Int. Cl.
*B65D 6/00* (2006.01)
*B65D 8/14* (2006.01)

(52) U.S. Cl. ..... 220/6; 220/4.28

(58) Field of Classification Search ..... 220/4.28, 220/4.29, 4.31, 4.32, 4.33, 6
See application file for complete search history.

(56) References Cited

U.S. PATENT DOCUMENTS

| | | | | |
|---|---|---|---|---|
| 3,993,211 | A * | 11/1976 | Astle | 220/1.5 |
| 4,091,950 | A | 5/1978 | Craven | |
| 4,591,065 | A | 5/1986 | Foy | |
| 4,674,647 | A * | 6/1987 | Gyenge et al. | 220/6 |
| 4,693,386 | A | 9/1987 | Hughes et al. | |
| 4,917,255 | A | 4/1990 | Foy et al. | |
| 5,094,356 | A | 3/1992 | Miller | |
| 5,515,987 | A * | 5/1996 | Jacques et al. | 220/6 |
| 5,638,973 | A | 6/1997 | Dewey | |
| 5,725,119 | A * | 3/1998 | Bradford et al. | 220/6 |
| 5,797,508 | A | 8/1998 | Loftus et al. | |
| 5,938,059 | A | 8/1999 | Luburic | |
| 5,988,420 | A * | 11/1999 | Jacques et al. | 220/1.5 |
| 6,098,827 | A * | 8/2000 | Overholt et al. | 220/6 |
| 6,142,329 | A | 11/2000 | Dotan | |
| 6,209,741 | B1 | 4/2001 | Boucher-Giles | |
| 6,293,418 | B1 | 9/2001 | Ogden et al. | |
| 6,398,054 | B1 * | 6/2002 | Overholt et al. | 220/7 |
| 6,488,168 | B1 | 12/2002 | Wang | |
| 6,669,044 | B2 * | 12/2003 | Murakami et al. | 220/6 |
| 6,722,515 | B2 | 4/2004 | Rumpel | |
| 6,761,277 | B2 | 7/2004 | Dotan | |
| 6,820,761 | B1 | 11/2004 | Mouri et al. | |
| 7,066,332 | B2 * | 6/2006 | Kobayashi et al. | 206/600 |
| 2001/0027976 | A1 * | 10/2001 | Murakami et al. | 220/6 |

* cited by examiner

*Primary Examiner*—Anthony D. Stashick
*Assistant Examiner*—Harry A Grosso
(74) *Attorney, Agent, or Firm*—Mark M. Friedman

(57) ABSTRACT

A knock-down crate having a base associated with four sides. In a first embodiment, the base and the sides are hingedly interconnected. In alternative embodiments, the sides are detachably engageable with the base for deployment parallel to the length and breadth of the base. The upper surface of the base has an elongated recess extending most of the length and sized for receiving at least some of the sides. The sides can be deployed such that the base and four sides form a four-sided crate with the recess of the base contributing to the available volume of the crate. When not in use, at least some of the sides are received within the recess in the base for compact transportation.

14 Claims, 14 Drawing Sheets

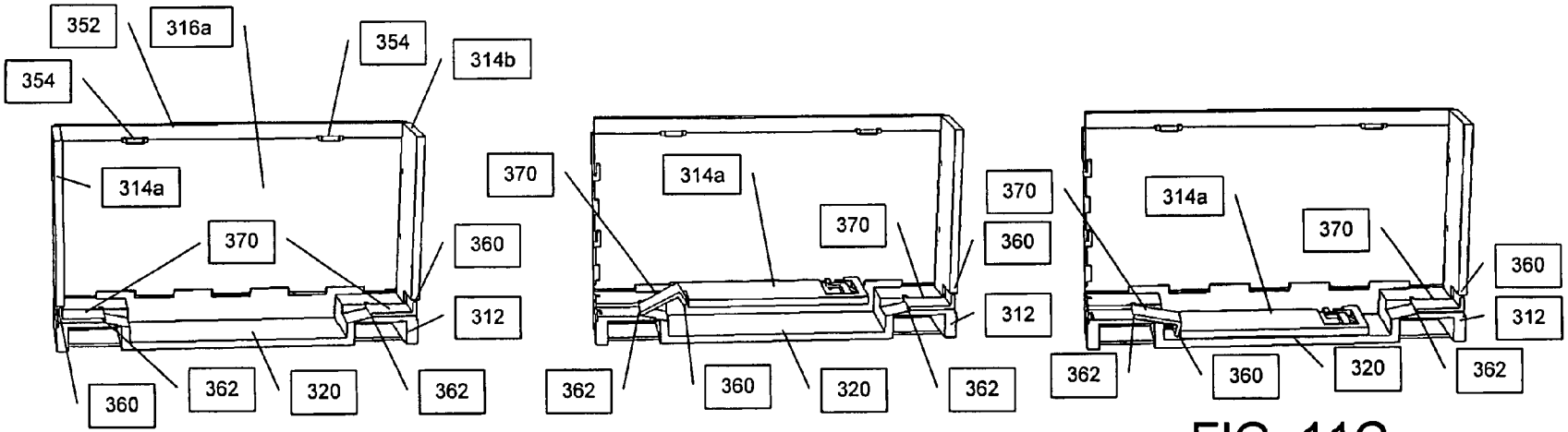
FIG. 11A
FIG. 11B
FIG. 11C
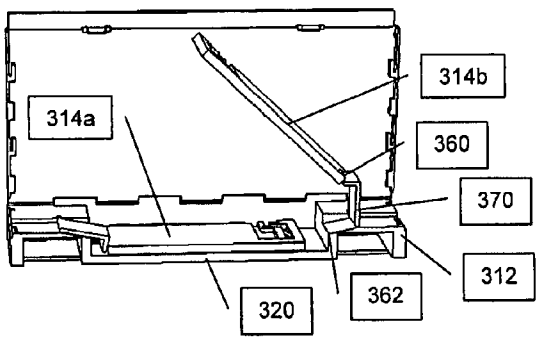
FIG. 11D
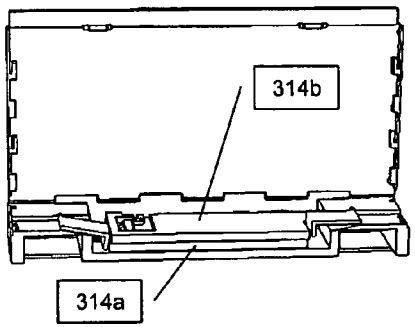
FIG. 11E

KNOCK-DOWN CRATE WITH WALLS STORED IN BASE AND METHOD EMPLOYING SUCH A CRATE

This application is a Continuation-In-Part of U.S. patent application Ser. No. 10/826,293 filed Apr. 19, 2004.

FIELD AND BACKGROUND OF THE INVENTION

The present invention relates to crates and, in particular, it concerns a knock-down crate in which the walls can be stored in a recess in the base, and a corresponding method for transporting produce.

It is known to provide containers of many types for transporting produce, manufactured articles, raw materials etc. from one location to another. Such containers are generally configured to be lifted by a fork-lift vehicle and are stackable. These containers, typically referred to as "bins", "box-pallets", "crates" or "totes", will be referred to generically herein as "crates".

In many cases, molded polymer containers are chosen for their light weight, robustness and long usable lifetime. To realize the maximum strength of the polymer materials, polymer crates are often molded in a single piece. As a result, however, they occupy the same volume when transported empty on a return journey as when full on an outbound journey. This extremely inefficient use of space is very costly.

Various disassembling or foldable crates have been developed in an attempt to reduce the transport volume requirements when the crates are empty. All such crates which either disassemble (i.e., come apart into separate elements) or fold (i.e., with all elements remaining interconnected) are referred to generically herein as "knock-down crates". An example of a foldable crate may be found in U.S. Pat. No. 5,094,356 to Miller. Examples of crates which disassemble may be found in U.S. Pat. No. 5,638,973 to Dewey et al., U.S. Pat. No. 6,142,329 to Dotan, and U.S. patent application Publication No. 2002/0084274 to Dotan. These publications are hereby incorporated by reference as if set forth entirely herein.

While offering more efficient use of volume, knock-down crates generally suffer from a number of disadvantages. Specifically with respect to crates which disassemble into separate elements, the base and the sides once separated are generally much less convenient to handle. Furthermore, the number of individual elements which must be handled is greatly increased, and considerable extra labor may be required for packing individual bases and sides compactly for volume-efficient transportation to the next point of use.

There is therefore a need for a knock-down crate in which the walls can be stored in a recess in the base for compact and convenient handling when unloaded.

SUMMARY OF THE INVENTION

The present invention is knock-down crate and a corresponding method for transporting produce.

According to the teachings of the present invention there is provided, a knock-down crate comprising: (a) a base having a length, a breadth, and an upper surface; and (b) a first pair of sides associated with the base and configured to alternate between a first deployment parallel to the length and a storage deployment, and a second pair of sides associated with the base configured to alternate between a first deployment parallel to the breadth and a storage deployment, wherein the upper surface of the base features an elongated recess extending substantially the entirety of the length, the recess being sized for receiving at least one of the first and second pairs of sides, such that, when the first and second pairs of sides are deployed in the first deployment, the base and the sides define a four-sided crate with the recess contributing to an internal volume of the crate, and when the first and second pairs of sides are deployed in the storage deployment, at least one of the first and second pairs of sides is receivable so as to be substantially contained within the recess for compact transportation.

According to a further teaching of the present invention, association of the first and second pairs of sides with the base includes hinged interconnection of at least one of the first and second pairs of sides with the base such that the at least one of the first and second pairs of sides is rotatable between the first deployment and the storage deployment.

According to a further teaching of the present invention, both the first and second pairs of sides are hingedly interconnected to the base.

According to a further teaching of the present invention, one of the first and second pairs of sides is receivable so as to be substantially contained within the recess and the other of the first and second pairs of sides covers the recess.

According to a further teaching of the present invention, the at least one of the first and second pairs of sides having the hinged interconnection includes at least the first pair of sides, and the first pair of sides is hingedly interconnect so as to allow each side of the pair to move away from an edge of the base when deployed in the recess.

According to a further teaching of the present invention, the hinged interconnection allows a base region of the each side to descend into a depth of the recess, so as to allow each of the sides of the first pair to lie parallel to the upper surface.

According to a further teaching of the present invention, at least one of the first and second pairs of sides includes attachment features configured so as to disengagably attach adjacent sides one to another when the first and second pairs of sides are deployed in the first deployment.

According to a further teaching of the present invention, the pair of sides that covers the recess folds such that each side of the pair folds over no more than half of one of the length and the breadth.

According to a further teaching of the present invention, the other of the first and second pairs of sides includes a foldable extension portion along a top region of at least one side of the pair of sides.

According to a further teaching of the present invention, the length is substantially equal to the breadth.

According to a further teaching of the present invention, the elongated recess is a closed-ended recess terminating at two end walls.

According to a further teaching of the present invention, each side of one of the first and second pair of sides has a length no greater than a length of the closed-ended recess.

According to a further teaching of the present invention, association of the first and second pairs of sides with the base is a detachable engagement such that the first and second pairs of sides, when detached from the base, are receivable so as to be substantially contained within the recess to attain the storage deployment.

According to a further teaching of the present invention, the length is substantially equal to the breadth.

According to a further teaching of the present invention, the first pair of sides and the second pair of sides are interchangeable.

According to a further teaching of the present invention, the elongated recess is an open-ended recess extending the entirety of the length.

According to a further teaching of the present invention, at least the second pair of sides each features a downwardly projecting tab configured to substantially close an end of the open-ended recess when the side is engaged with the base.

According to a further teaching of the present invention, the first pair of sides and the second pair of sides are interchangeable, the base including a pair of slots extending parallel to the length and configured for receiving the downwardly projecting tab of the first pair of sides.

According to a further teaching of the present invention, the elongated recess is a closed-ended recess terminating at two end walls.

According to a further teaching of the present invention, each side of the first and second pair of sides has a length no greater than a length of the closed-ended recess.

According to a further teaching of the present invention, each side of the first and second pairs of sides includes attachment features for attachment to two adjacent sides, and wherein the attachment features are further configured such that each pair of the sides are doubly-interlockable to form a unit with the pair of sides associated in close parallel relation.

According to a further teaching of the present invention, upper and lower edges of the first and second pairs of sides and upper and lower peripheral regions of the base are formed with complementary alignment projections and recesses such that, when the first and second pairs of sides are engaged with the base to form the four-sided crate, the alignment projections and recesses on the upper edges of the sides and on the lower peripheral region of the base serve to align the four-sided crate with similar crates placed above and below the four-sided crate, and when the first and second pairs of sides are received within the recess, the alignment projections and recesses on the upper and lower peripheral regions of the base serve to align the base with similar bases placed above and below the base.

According to a further teaching of the present invention, the base and the first and second pairs of sides are all formed primarily from molded plastic material.

According to a further teaching of the present invention, the base has a pair of elongated channels extending parallel to the length for receiving tines of a forklift mechanism.

According to a further teaching of the present invention, a major part of the recess lies between the elongated channels.

There is also provided according to the teachings of the present invention, a method for using a knock-down crate to transport produce from a loading location to an unloading location, the method comprising the steps of: (a) providing a knock-down crate having: (i) a base with an upper surface including an elongated recess, and (ii) four sides deployable in a crate configuration wherein the four sides are engaged with the base and each other to form a four-sided crate, the four sides being further deployable in a knock-down configuration wherein the four sides are deployed in a storage deployment with at least two of the four sides received substantially within the elongated recess; (b) deploying the crate in the crate configuration; (c) loading the crate at the loading location with produce, at least part of the produce lying within the elongated recess; (d) transporting the produce in the crate to the unloading location; (e) unloading the produce from the crate; and (f) deploying the crate in the knock-down configuration with at least two of the four sides located substantially within the elongated recess for transport to a next loading location.

According to a further teaching of the present invention, upper and lower edges of the sides and upper and lower peripheral regions of the base are formed with complementary alignment projections and recesses, the method further comprising: (a) stacking the crate when in the crate configuration with other similar crates such that the alignment projections and recesses on the upper edges of the sides and on the lower peripheral region of the base serve to align the crate with the other similar crates placed above and below the crate; and (b) stacking the crate when in the knock-down configuration with other similar crates such that the alignment projections and recesses on the upper and lower peripheral regions of the base serve to align the crate with the other similar crates placed above and below the crate.

BRIEF DESCRIPTION OF THE DRAWINGS

The invention is herein described, by way of example only, with reference to the accompanying drawings, wherein:

FIGS. 11A-11E are isometric cross sections of the embodiment of FIG. 1 illustrating, in sequence, step of folding one pair of sides into the recess for deployment to the storage deployment;

DESCRIPTION OF THE PREFERRED EMBODIMENTS

The present invention is a knock-down crate in which the walls can be stored in a recess in the base for compact and convenient handling when unloaded, and a corresponding method for transporting produce.

The principles and operation of knock-down crates according to the present invention may be better understood with reference to the drawings and the accompanying description.

By way of introduction, the crate of the present invention includes a base associated with four sides. The principles of the present invention will be discussed herein with regard to three basic embodiments. The first embodiment, in which the base and the sides are hingedly interconnected, will be discussed regarding FIGS. 1-11E. The second and third embodiments, in which the sides are detachably engageable with the base, will be discussed with regard to FIGS. 12A-18 and 19-23, respectively.

Figure 1:
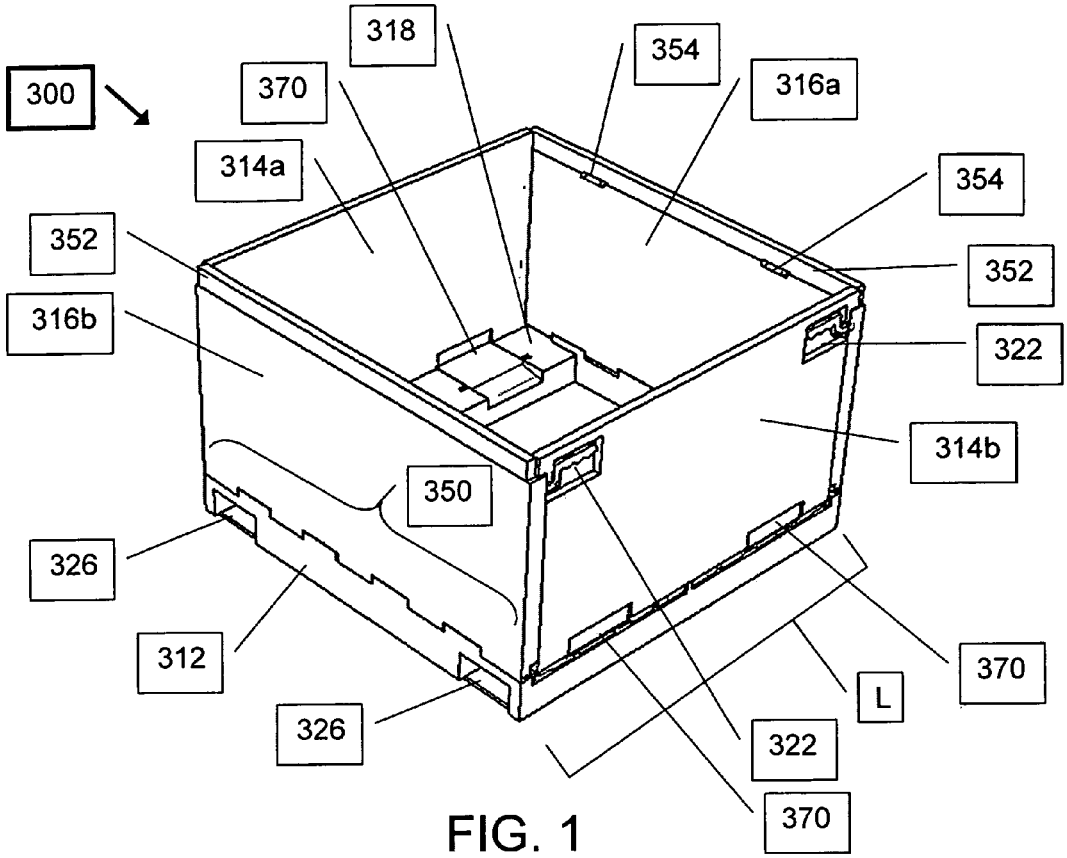
FIG. 1 is an isometric view of a first embodiment of a knock-down crate constructed and operative according to the teachings of the present invention, in which the four sides are hingedly interconnected to the base.
Figure 2:
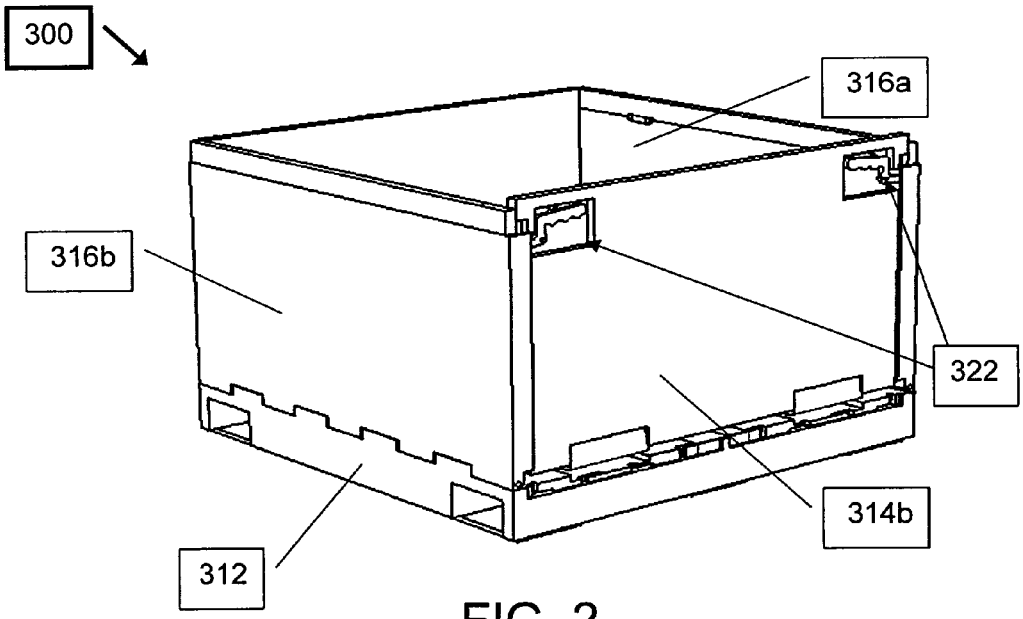
FIGS. 2-10 are isometric views of the embodiment of FIG. 1, illustrating, in sequence, steps for folding the crate from the assembled deployment to the storage deployment.

Referring now to the drawings, FIG. 1 shows a first preferred embodiment of a knock-down crate, generally designated 300, constructed and operative according to the teachings of the present invention. Generally speaking, crate 300 is formed from a base 312 and two pairs of sides 314*a* and 314*b*, 316*a* and 316*b* all four of which are hingedly interconnected to base 312. In this embodiment, sides 314*a* and 314*b* are interconnected to base 312 by a non-limiting example of a double hinge 370, as will be discussed in detail below the regard to FIGS. 11A-11E.

Sides 316*a* and 316*b* are hingedly interconnected to base 312 by hinge 350 that, in this non-limiting example, extends for substantially the entire length of each side. It should be noted that substantially any suitable hinge arrangement is within the scope of the present invention. An upper surface 318 of base 312 features an elongated recess 320 extending substantially the entirety of a length L of base 312 and sized for receiving sides 314*a* and 314*b* in a storage deployment. Once sides 314*a* and 314*b* are stored in recess 320, sides 316*a* and 316*b* are folded inwardly to cover sides 314*a* and 314*b*, recess 320 and the exposed portions of upper surface 318 of base 312. It should be noted that the word "inwardly" is used herein to refer to movement toward the center of the crate.

Figure 3:
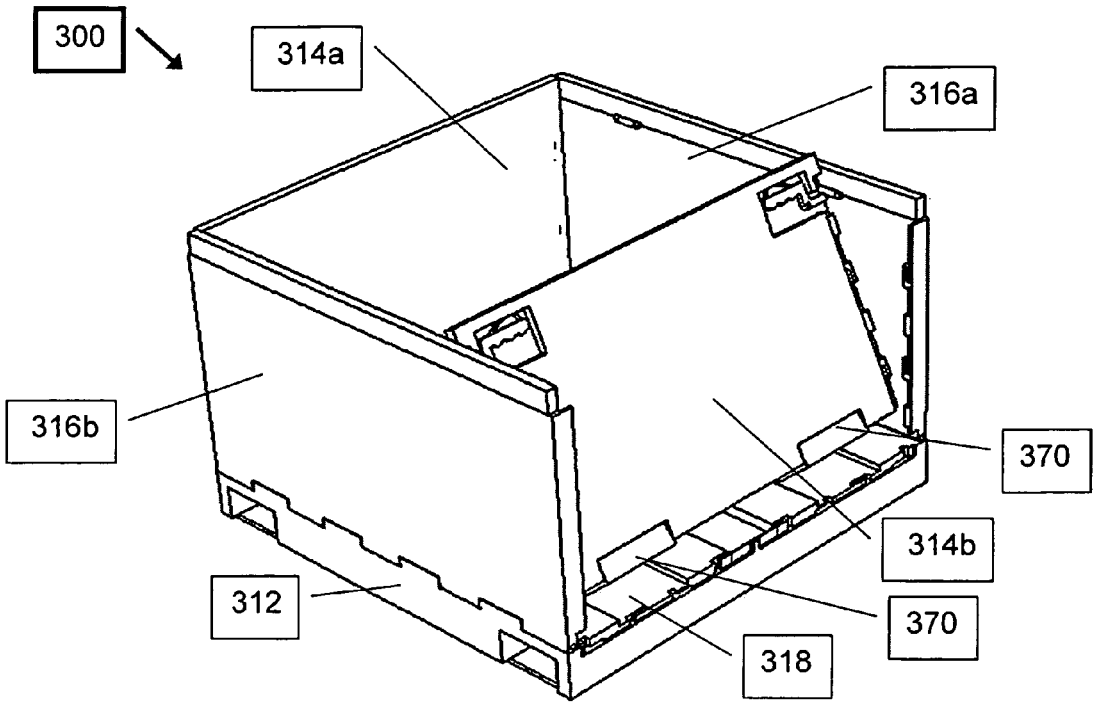
Figure 4:
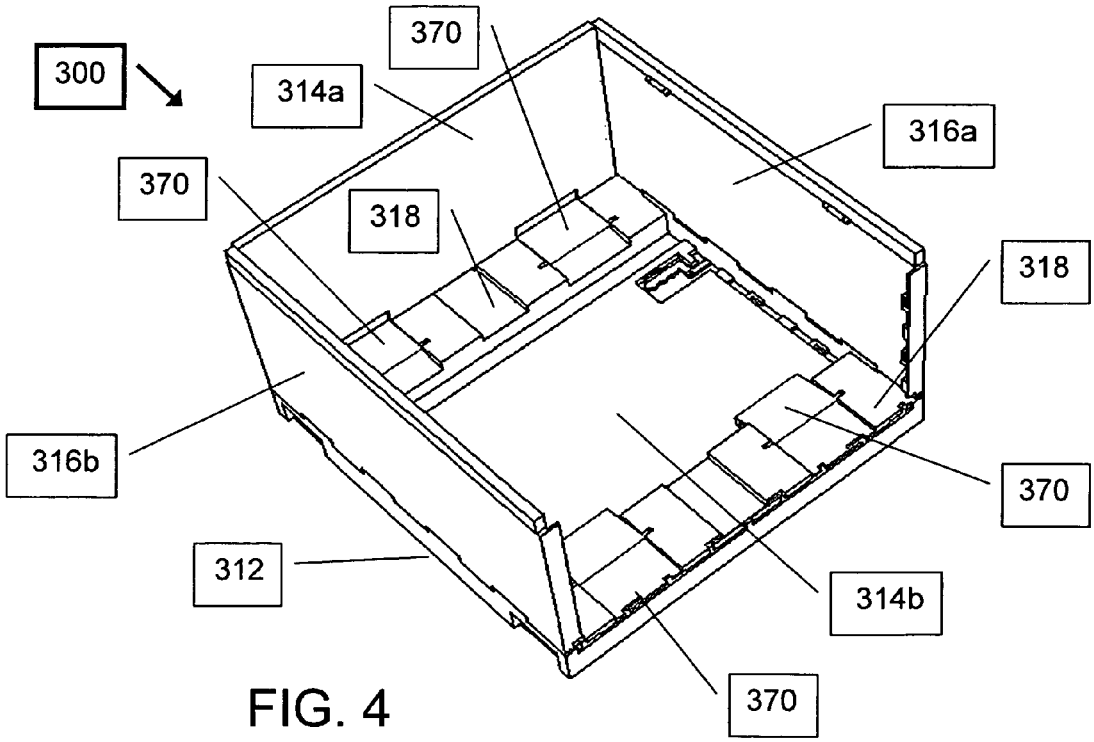
Figure 5:
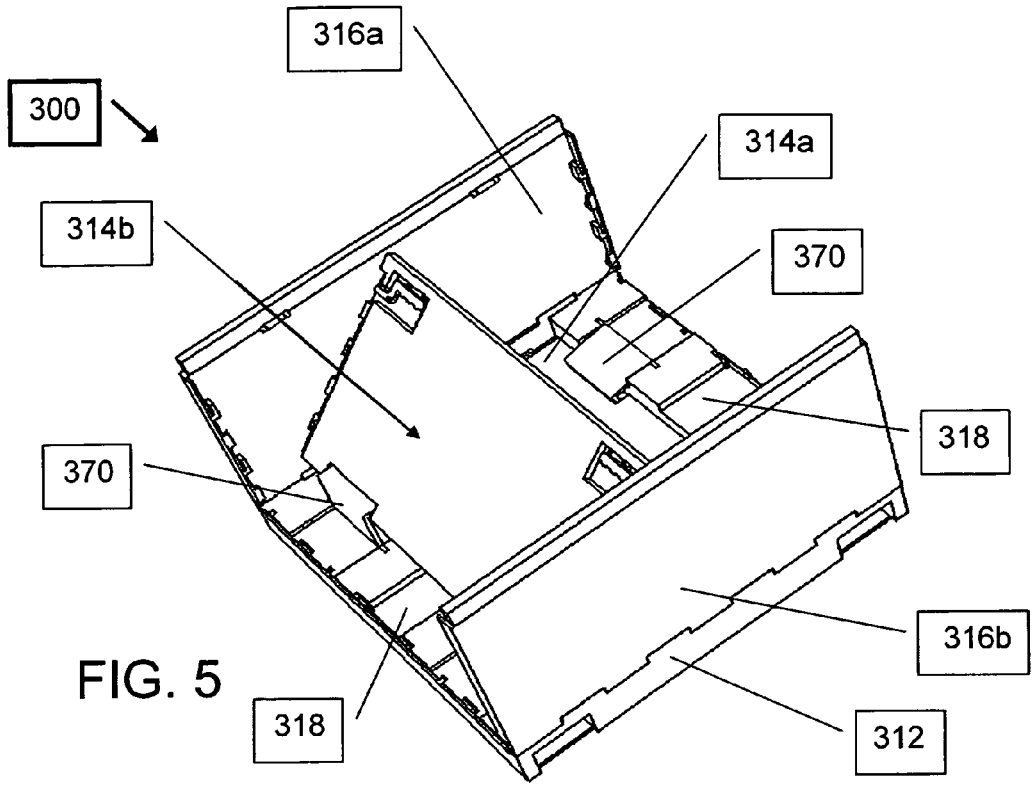
Figure 6:
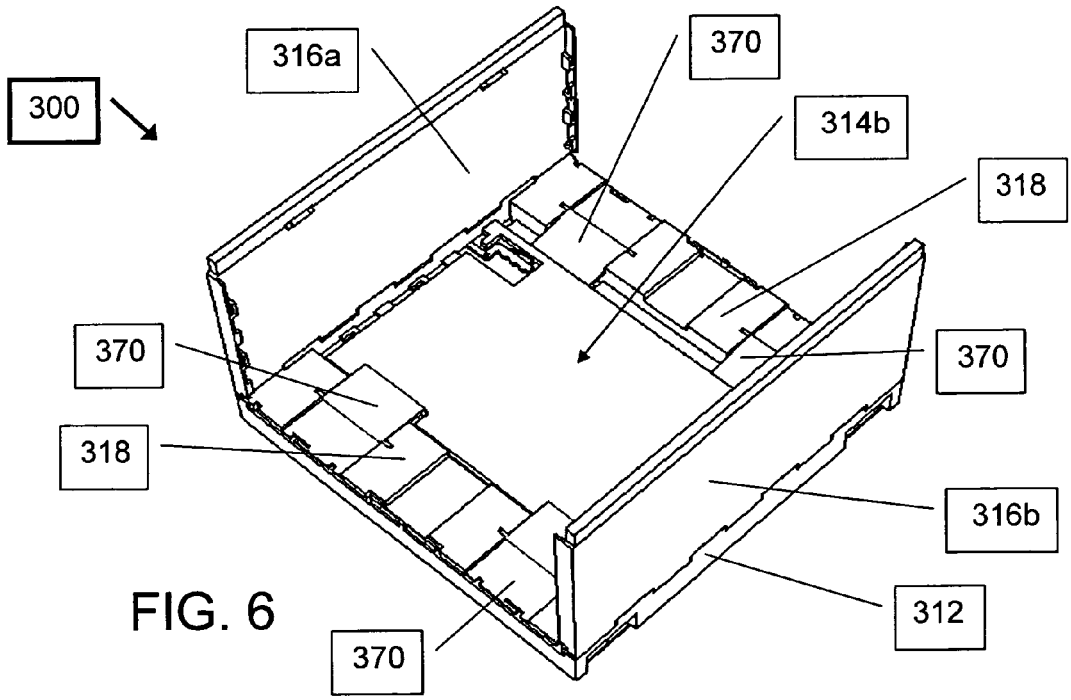

FIGS. 2-10 illustrate steps for deploying the two pairs of sides 314*a* and 314*b*, 316*a* and 316*b* into their respective storage deployments. First, any attachment feature that secures one of the sides to an adjacent side is disengaged. The illustration here shows handles 322 configured in sides 314*a* and 314*b*, however, substantially any disengageable attachment configuration, as discussed below with regard to a second and third preferred embodiments, may be used. Once disengaged from the adjacent sides 316*a* and 316*b*, side 314*b* is folded inwardly, as seen in FIG. 3, until it is received into recess 320, as seen in FIG. 4. Side 314*a* is then disengaged from the adjacent sides 316*a* and 316*b*, and folded inwardly, as seen in FIG. 5, until it is received into recess 320 and resting on side 314*b*, as seen in FIG. 6. It should be noted that this sequence may be reversed and side 314*a* may be stored away first with 314*b* resting on top.

Figure 7:
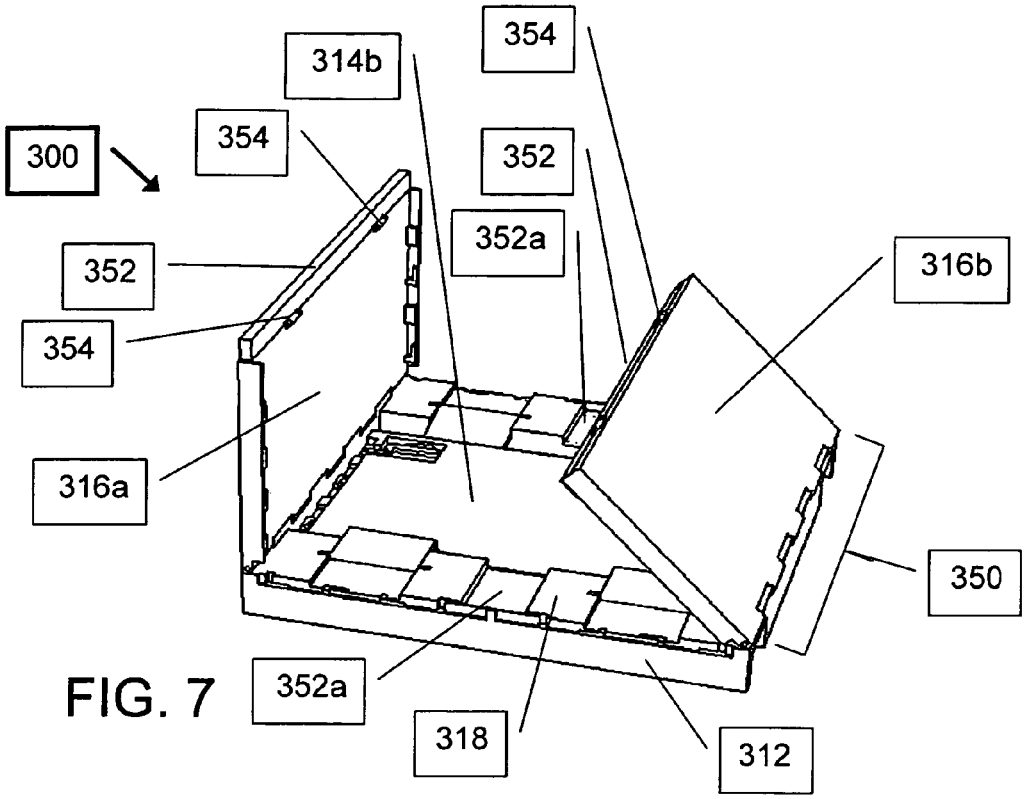
Figure 8:
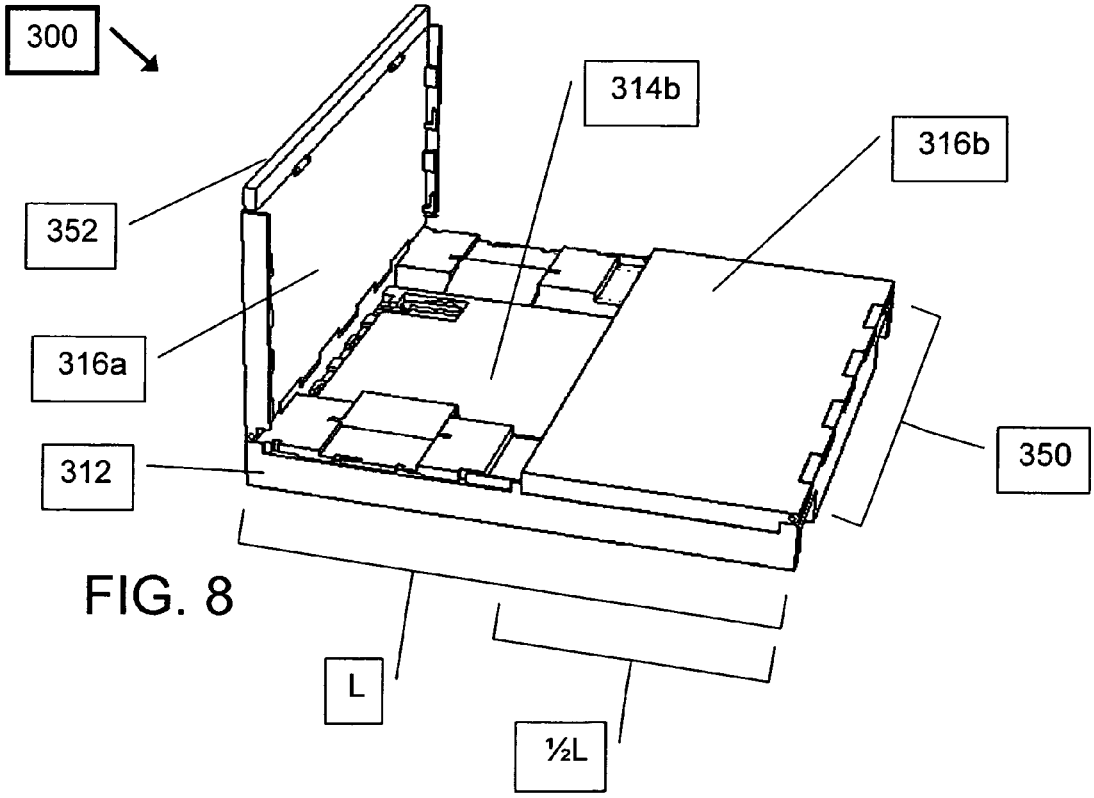

Next, side 316*b* is folded inwardly, as seen in FIG. 7, until it is resting on the upper surface 318 of the base 312, as seen in FIG. 8. As illustrated in FIG. 8, when in the storage deployment, side 316*b* is preferably no longer than one-half (½L) of the length L of base 312 in order to add not more than one side thickness to the thickness of the base in the overall thickness of the storage configuration of the crate. In some applications sides 316*a* and 316*b* may need to be longer than one-half (½L) of the length L of base 312. For such applications, the present invention provides a foldable extension 352 hingedly attached along the top edge of at least one of sides 316*a* and 316*b*. The foldable extension 352 is attached by hinges 354, and is folded into the associated side during the folding process of the side. A transverse recess 352*a* is preferably provided in the base and/or folded sides to accommodate the foldable extensions without adding significantly to the thickness of the folded configuration.

Figure 9:
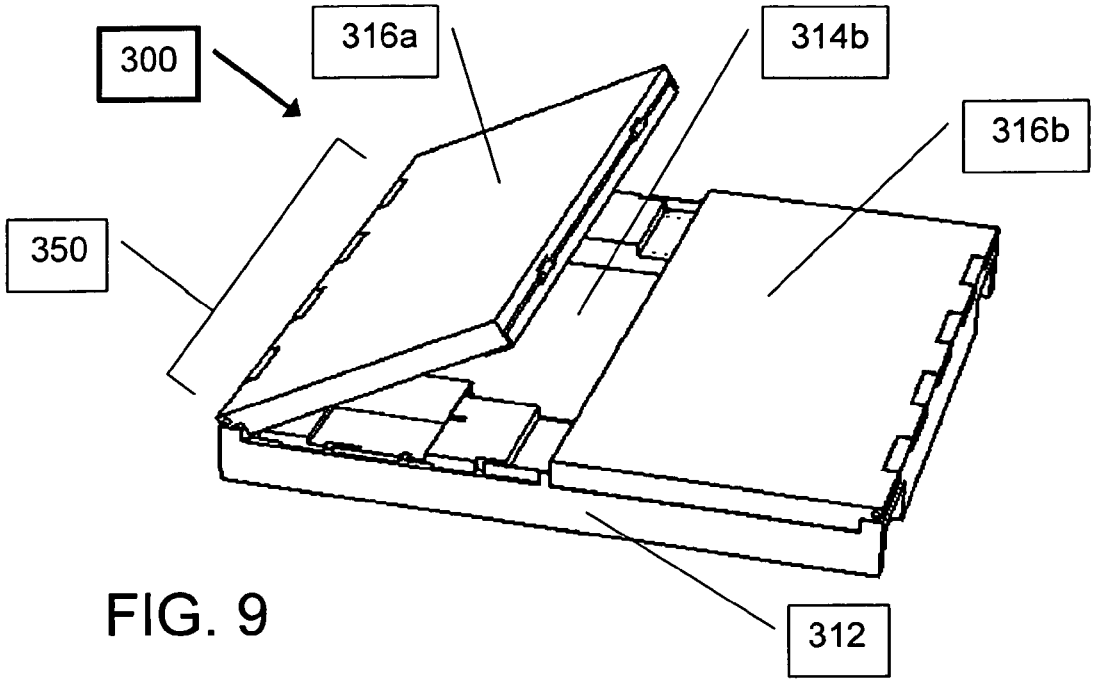
Figure 10:
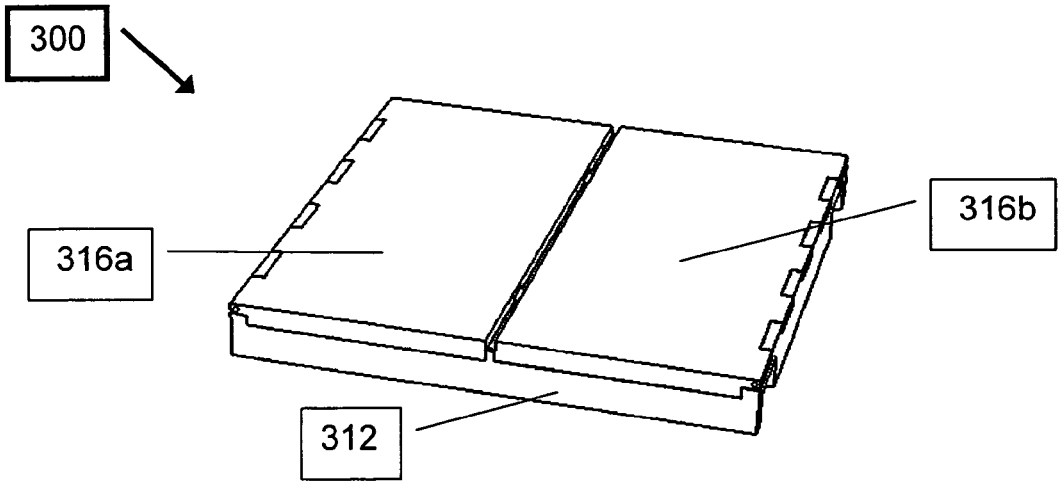
Figure 12A:
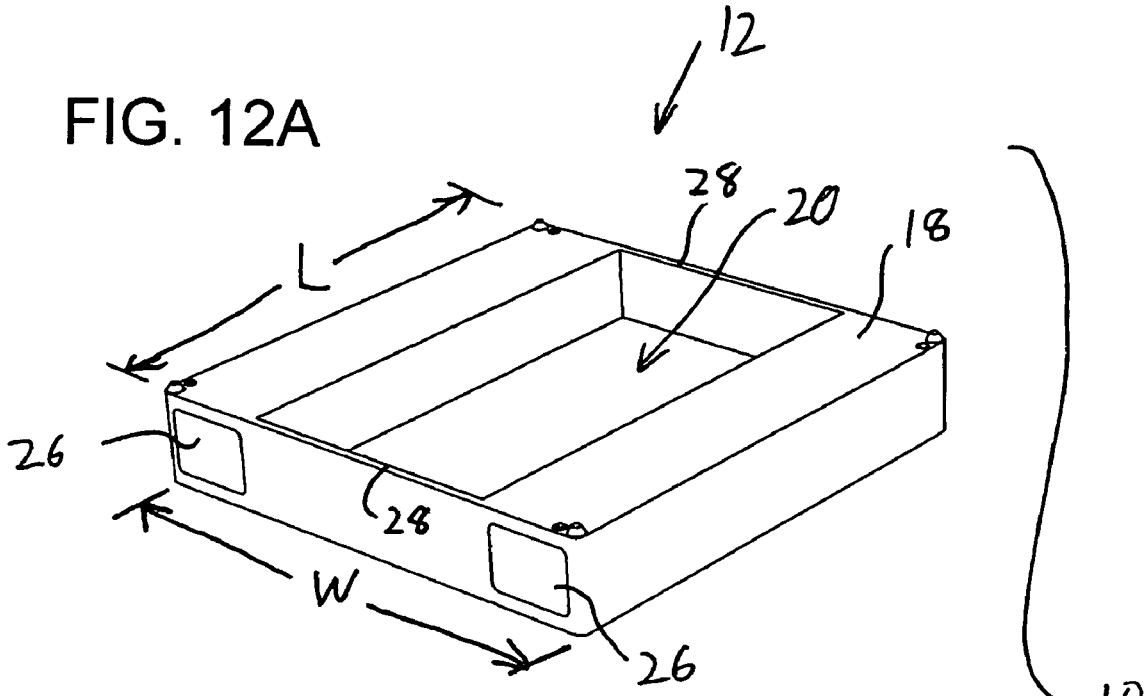
FIGS. 12A and 12B are schematic isometric views of a base and a set of four sides, respectively, for use in a second embodiment of a knock-down crate constructed and operative according to the teachings of the present invention, in which the four sides are detachably engaged with the base.
Figure 12B:
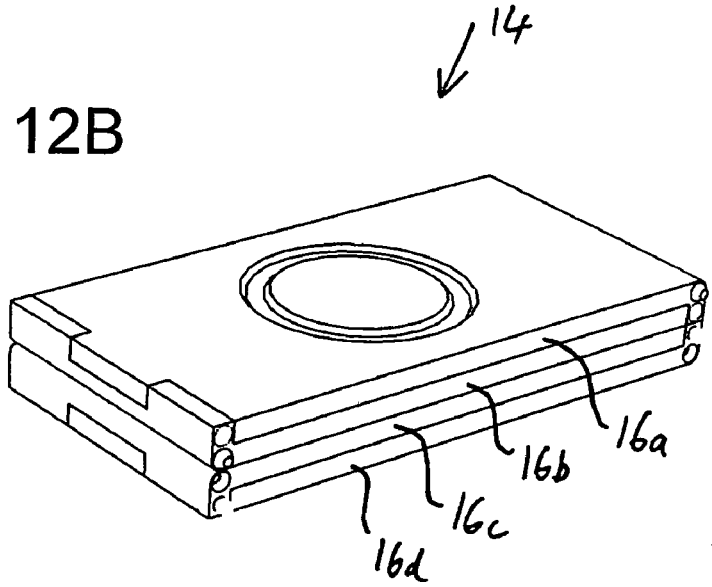

Side 316*a* is then folded inwardly, as seen in FIG. 9, until it is resting on the upper surface 318 of the base 312, as seen in FIG. 10. When both sides 316*a* and 316*b* are in the storage deployment, substantially all of the upper surface 318 of the base 312, recess 320, and sides 314*a* and 314*b* are covered by sides 316*a* and 316*b*.

In order for sides 314*a* and 314*b* to be deployed in recess 320 that is located between channels 326, as discussed below, it is necessary for sides 314*a* and 314*b* to move away form the edge of base 312, and preferably also to be able to descend at least partially into the depth of recess 320. Further, it is also preferable that the base region of the side, that is the region of the side that abuts base 312, descend into the depth of recess 320, so as to allow each of the side to lay parallel to the upper surface 318. FIGS. 11A-11E illustrate a non-limiting preferred hinged configuration for such interconnection of base 312 and sides 314*a* and 314*b*, and steps for deploying sides 314*a* and 314*b* into their respective storage deployments. It should be noted that other hinge configurations may be suitable for this purpose. Such hinge configurations may include, but are not limited to, a slideable hinge, and a hinge pin associated with a slot.

As illustrated, hinge bracket 370 provides rotation about two axes of rotation, 360 and 362. When side 314*a* is folded inwardly, rotation about axis 362 allows the bottom edge of side 314*a* to move away from the edge of base 312 in order to reach recess 320, as seen in FIG. 11. Rotation about axis 360 allows side 316*a* to lay flat when received in recess 320, as seen in FIG. 11C. The "L" shape of bracket 370 allows the base region of the side to descend into the depth of recess 320, so as to allow each of the sides 314*a* and 314*b* to lay parallel to the upper surface 318. The process is repeated when side 314*b* is brought into its storage deployment, as illustrated in FIGS. 11D and 11E. It will be understood that this discussion of the double hinge configuration is intended only as an example of a hinged interconnection between the base 312 and sides 314*a* and 314*b*, and that other configurations that will provide substantially the same results are possible. It should be noted that a crate in which sides 314*a* and 314*b* may be detached from base 312 for insertion into recess 320 is within the scope of the present invention.

Crate 300 is preferably configured for handling by standard pallet handling equipment. To this end, as illustrated in FIG. 1, base 312 preferably has a pair of elongated channels 326 extending parallel to length L for receiving tines of a forklift mechanism (forklift, pallet carrier etc.). Channels 326 typically extend along the entirety of length L, allowing insertion of tines from either end of the crate. Most preferably, at least a major portion of recess 320 is located between channels 326. Thus, considered from a different point of view, crate 300 may be considered to have a thin base 312 in the region of recess 320, with locally raised regions to provide the volume required for channels 326. It will thus be understood that the usable volume of the inside of the crate is fully maximized by making all volume other than that required for channels 326 available for loading with produce.

FIGS. 12A-18 show a second preferred embodiment of a knock-down crate, generally designated 10, constructed and operative according to the teachings of the present invention. Generally speaking, crate 10 is formed from a base 12 and a set 14 of sides 16*a*, 16*b*, 16*c* and 16*d*. An upper surface 18 of base 12 features an elongated recess 20 extending substantially the entirety of a length L of the base and sized for receiving set of sides 14.

Figure 13:
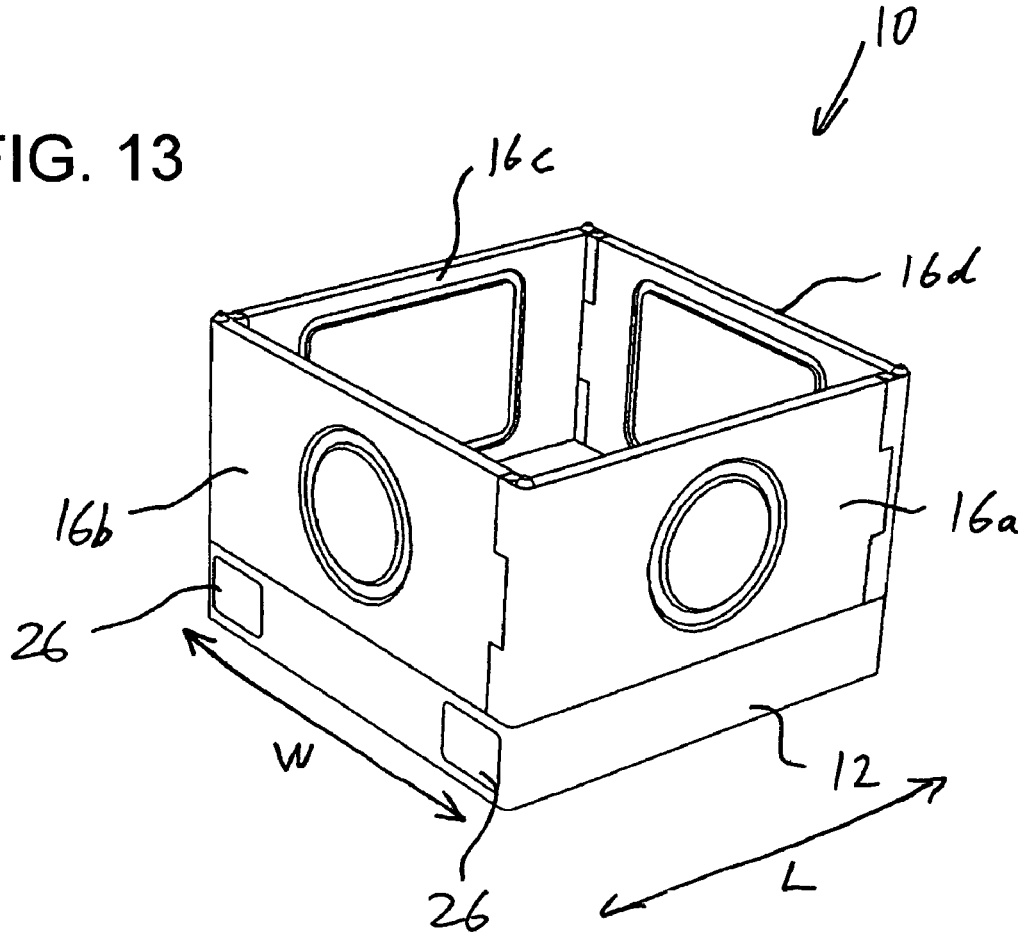
FIG. 13 is a schematic isometric view of a four-sided crate constructed from the base and sides of FIGS. 12A and 12B.
Figure 14:
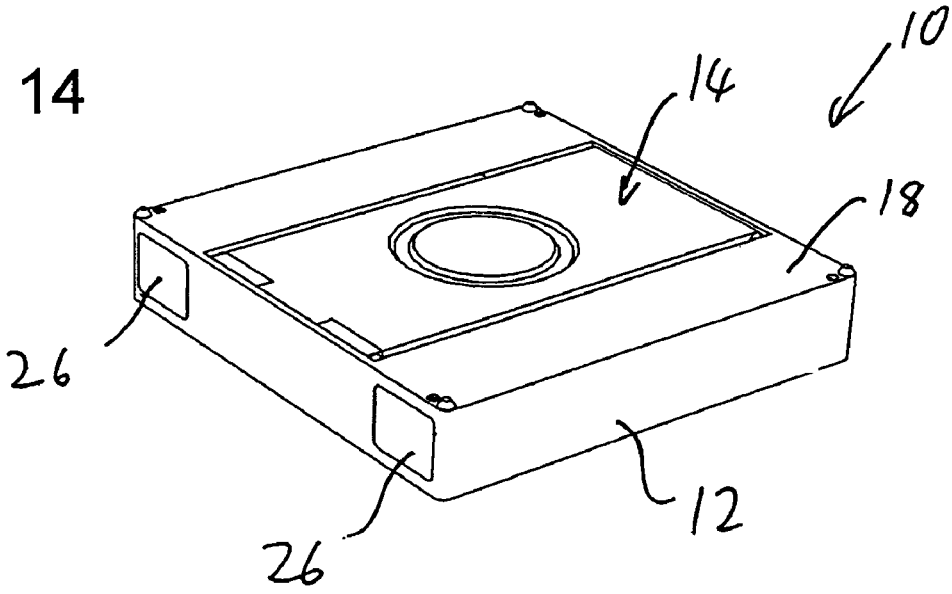
FIG. 14 is a schematic isometric view showing the sides of FIG. 12B received within a recess in the base of FIG. 12A.

The sides are configured to be detachably engageable with base 12 with a first pair 16*a* and 16*c* parallel to the length L of base 12 and a second pair 16*b* and 16*d* parallel to a breadth or width W of base 12 such that, when sides 16*a*, 16*b*, 16*c* and 16*d* are engaged with base 12, the base and the sides define a four-sided crate 10 as shown in FIG. 13 with recess 20 contributing to an internal volume of the crate. When the crate is unloaded and the sides are detached from the base, the set 14 of sides 16*a*, 16*b*, 16*c* and 16*d* are received so as to be substantially contained within recess 20 to form the knocked-down configuration of FIG. 14 for compact transportation.

It will be immediately appreciated that the crate of the present invention offers profound advantages over conventional knock-down crates. Specifically, in the assembled configuration of FIG. 13, recess 20 contributes significantly to the usable internal volume of the crate, thereby maximizing transport volume. In the knocked-down state of FIG. 14, all parts of the crate are configured in a single compact block which is easily handled and can be efficiently stacked with other similar crates to ensure minimum volume for return transportation or storage of the crate when not in use. These and other advantages of the present invention will be better understood from the following detailed description.

Turning now to the features of crate 10 in more detail, it is a preferred feature of certain implementations of the present invention that the crate is a square crate, i.e., that length L is substantially equal to breadth W. In most preferred cases, all four sides are then made interchangeable such that the user can assemble the crate with each side located arbitrarily along any edge of the base.

Figure 15:
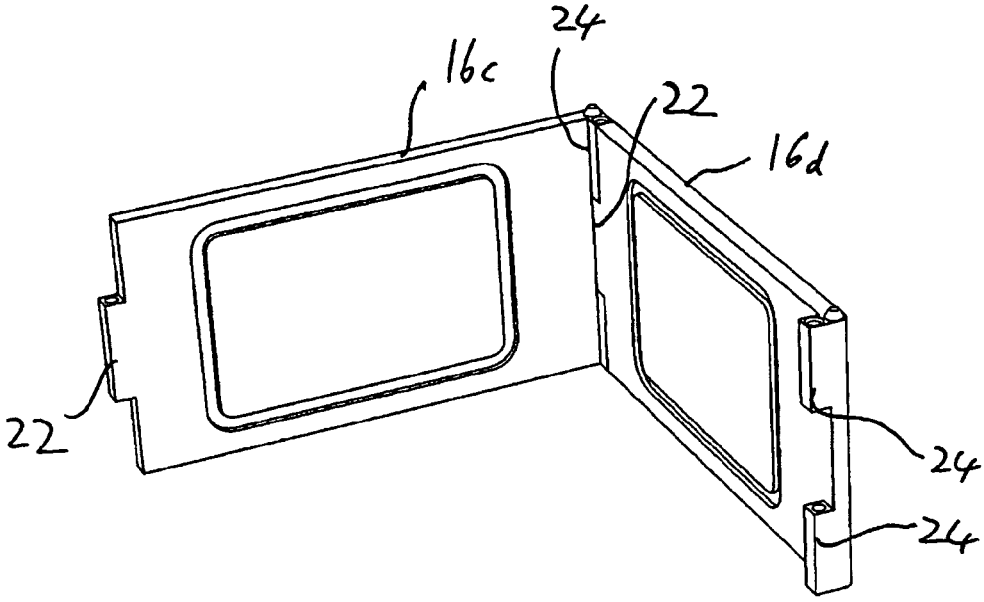
FIG. 15 is a schematic isometric view showing the interconnection of two of the sides of FIG. 12B.
Figure 16A:
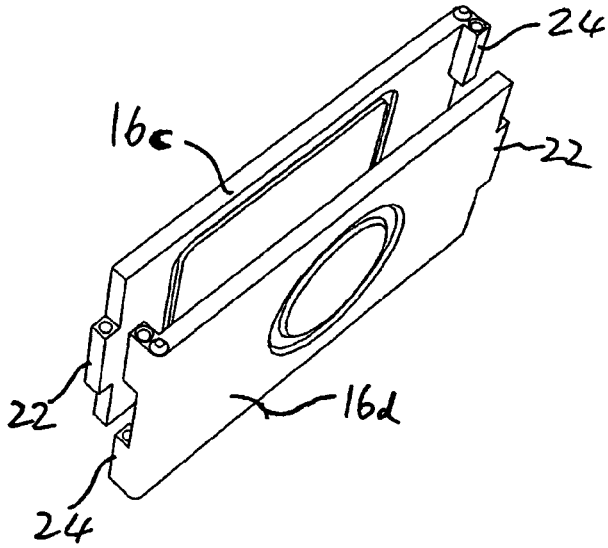
FIGS. 16A and 16B are schematic isometric views showing two of the sides of FIG. 12B immediately prior to, and after, interconnection to form a two-side unit.
Figure 16B:
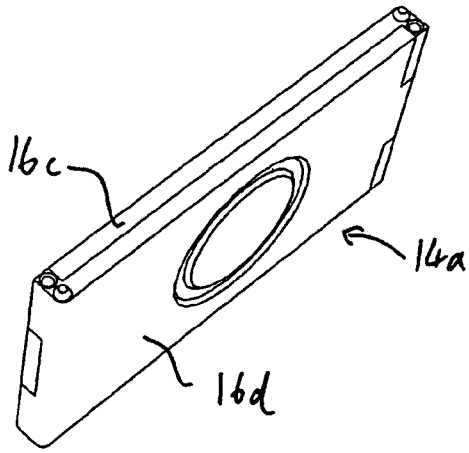
Figure 17:
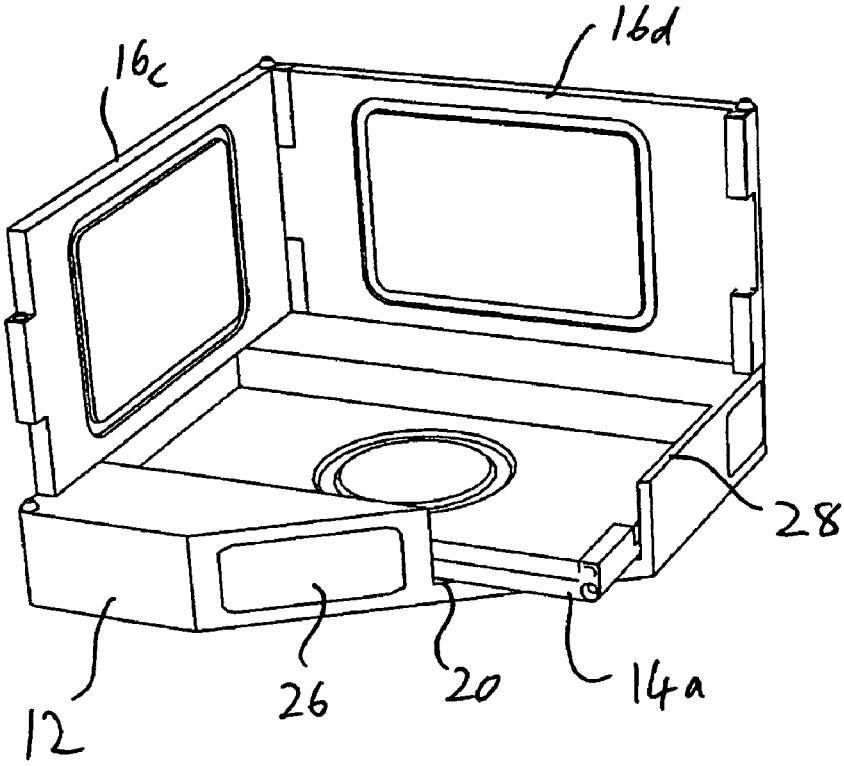
FIG. 17 is a schematic partially cut-away isometric view of the crate of the present invention during assembly or disassembly.
Figure 18:
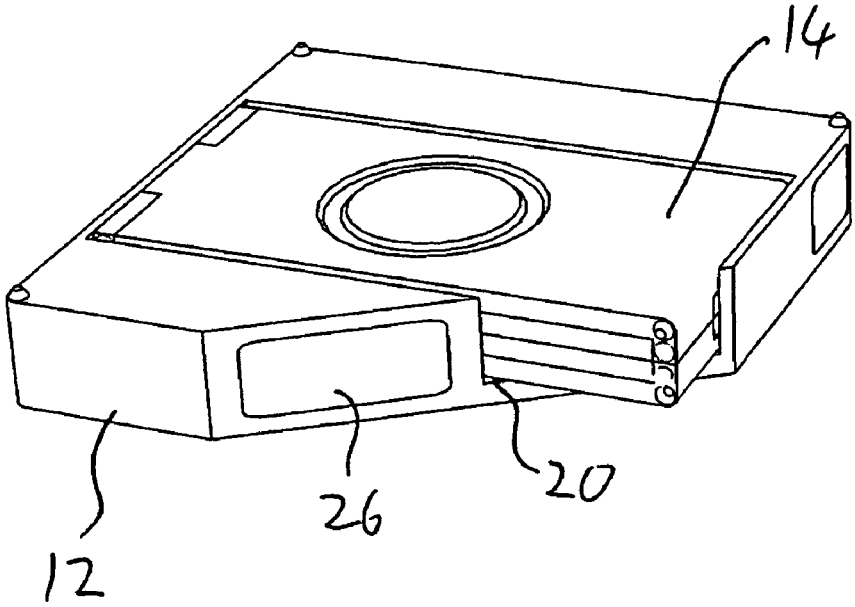
FIG. 18 is a schematic partially cut-away isometric view of the knocked-down crate of FIG. 14.
Figure 19A:
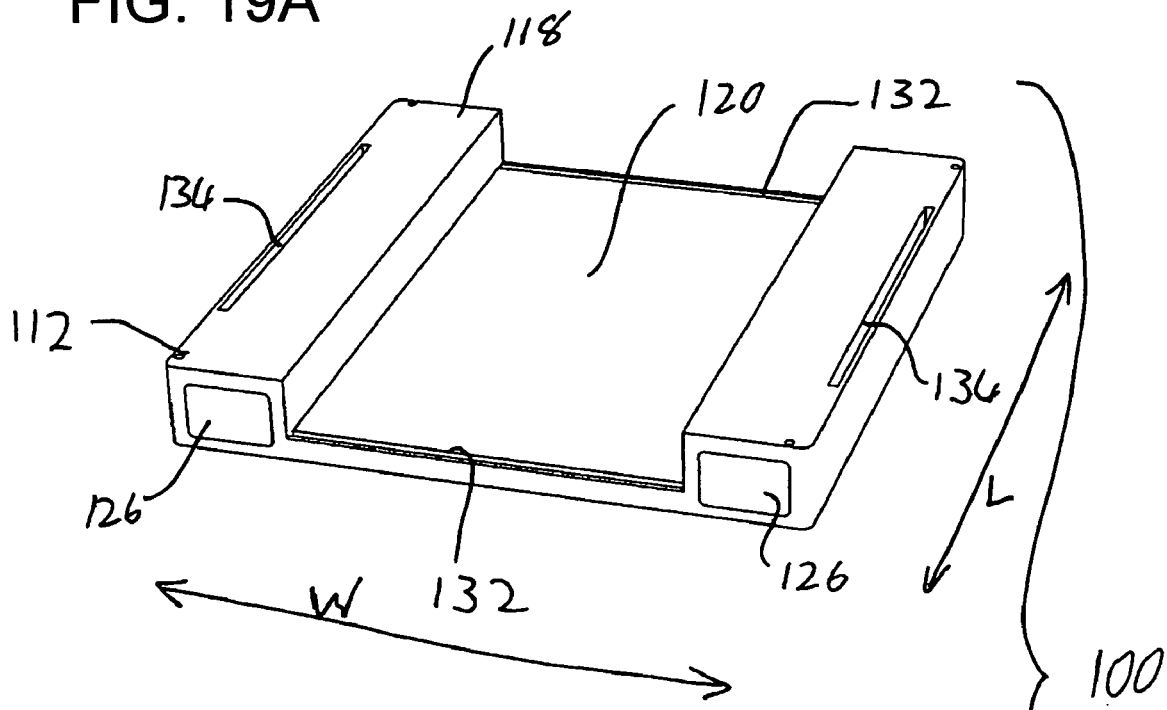
FIGS. 19A and 19B are schematic isometric views of a base and a set of four sides, respectively, for use in a third embodiment of a knock-down crate constructed and operative according to the teachings of the present invention.
Figure 19B:
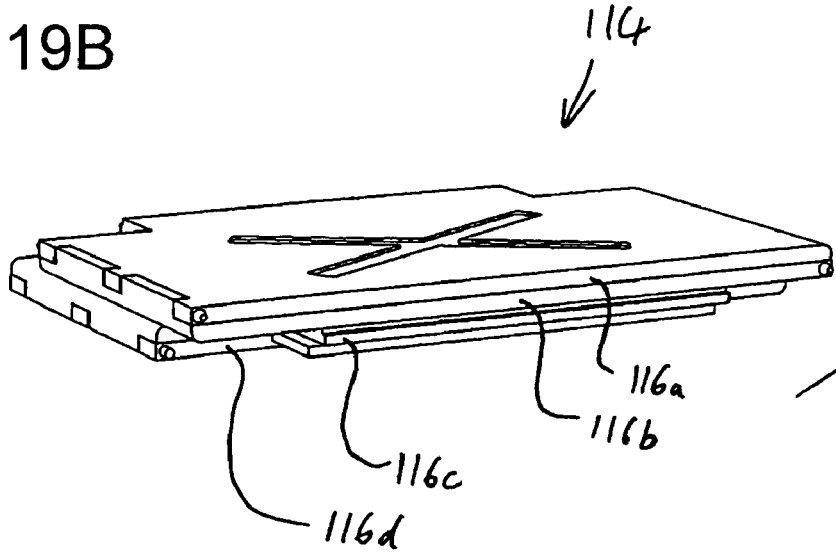

In order to form a usable crate, it is clearly necessary to achieve load-bearing engagement between adjacent sides of the assembled crate and between each side and the base. Thus, each of sides 16*a*, 16*b*, 16*c* and 16*d* includes attachment features 22, 24 for attachment to two adjacent sides. FIG. 15 illustrates two interconnected sides 16*c* and 16*d*, with their available attachment features clearly visible. The attachment features are shown here schematically as complementary rectangular-section interlocking tabs with through-bores for receiving a bolt element to lock the sides together and to the base. Most preferably, attachment features 22, 24 are further configured such that pairs of the sides are doubly-interlockable to form a unit 14*a* with the pair of sides associated in close parallel relation. FIGS. 16A and 16B show such a unit 14*a* prior to and after interconnection. FIG. 17 shows a cut-away view of crate 10 partially assembled with one unit 14*a* stored in recess 20. Two such units together make up an easily handled set 14 of sides for insertion into recess 20 as shown in FIG. 18.

It should be appreciated that the attachment features shown here are represented schematically. Various engagement configurations for removably engaging sides with a base and with each other to form a knock-down crate are known in the art. The specific choice of engagement configuration, other than certain features discussed explicitly herein, does not constitute part of the present invention per se and for conciseness will not be described here in detail. By way of non-limiting examples, the various engagement and locking configurations described in the aforementioned U.S. Pat. No. 6,142,329 to Dotan, and/or U.S. patent application Publication No. 2002/0084274 to Dotan are considered suitable for implementation of the present invention.

Optionally, a locking arrangement (not shown) may be provided to retain set of sides 14 within recess 20 to ensure that the set of sides do not become dislodged during handling. Most preferably, at least one locking element used for interlocking the sides when assembled also functions to selectively lock the set of sides within recess 20 when in the knock-down configuration. Such an implementation is well within the capabilities of one ordinarily skilled in the art.

In most preferred implementations, base 12 and sides 16*a*, 16*b*, 16*c* and 16*d* are all formed primarily from molded plastic material. It should be noted, however, that implementations of the crate structure described using materials other than molded plastics also fall within the broad scope of the present invention. The various components of the crates of the present invention are illustrated here schematically and simplistically for clarity of presentation. The geometrical patterns shown here on the sides of the crates are non-functional and are included merely to facilitate visual differentiation between the inward-facing and outward-facing surfaces. It will be understood by one ordinarily skilled in the art that the various components will typically be implemented with various structures of reinforcing ribs and/or other functional or decorative features which do not per se constitute part of the present invention. Furthermore, depending upon the type of produce to be transported and the desired drainage characteristics of the crate, the base and walls may be made either solid or with drainage and ventilation openings, as is known in the art.

Crate 10 is preferably configured for handling by standard pallet handling equipment. To this end, base 12 preferably has a pair of elongated channels 26 extending parallel to length L for receiving tines of a forklift mechanism (forklift, pallet carrier etc.). Channels 26 typically extend along the entirety of length L, allowing insertion of tines from either end of the crate. Most preferably, at least a major portion of recess 20 is located between channels 26. Thus, considered from a different point of view, crate 10 may be considered to have a thin base 12 in the region of recess 20, with locally raised regions to provide the volume required for channels 26. It will thus be understood that the usable volume of the inside of the crate is fully maximized by making all volume other than that required for channels 26 available for loading with produce. Furthermore, since the sides are stored between the regions of base 12 containing channels 26, nothing overlies the regions of the base 12 containing channels 26 in the collapsed state, making the height of the crate in its collapsed state significantly less than that of "fold-down" crates of similar dimensions.

According to the second preferred embodiment of the present invention shown here, elongated recess 20 is a closed-ended recess terminating at two end walls 28. As a result, the length of recess 20 is slightly less than the external length L of base 12. To ensure that sides 16*a*, 16*b*, 16*c* and 16*d* fit within recess 20, each side preferably includes one corner portion of the assembled crate, with part of the adjacent side or at least engagement features for the adjacent side extending laterally from the corner portion. As a result, the length of each side is less than the external length dimension of the assembled crate by the thickness of one corner portion, preferably at least equal to a thickness of the crate side. Thus, if end walls 28 have a thickness no more than about half the thickness of sides 16*a*, 16*b*, 16*c* and 16*d*, the sides can be accommodated within recess 20.

Turning now to FIGS. 19A-21, there is shown a third preferred embodiment of a crate, generally designated 100, constructed and operative according to the teachings of the present invention. Crate 100 is structurally and functionally similar to crate 10 described above. For clarity and conciseness, features of crate 100 analogous to those of crate 10 are labeled with reference numerals greater by 100 than the numeral used for the analogous feature of crate 10.

Figure 20:
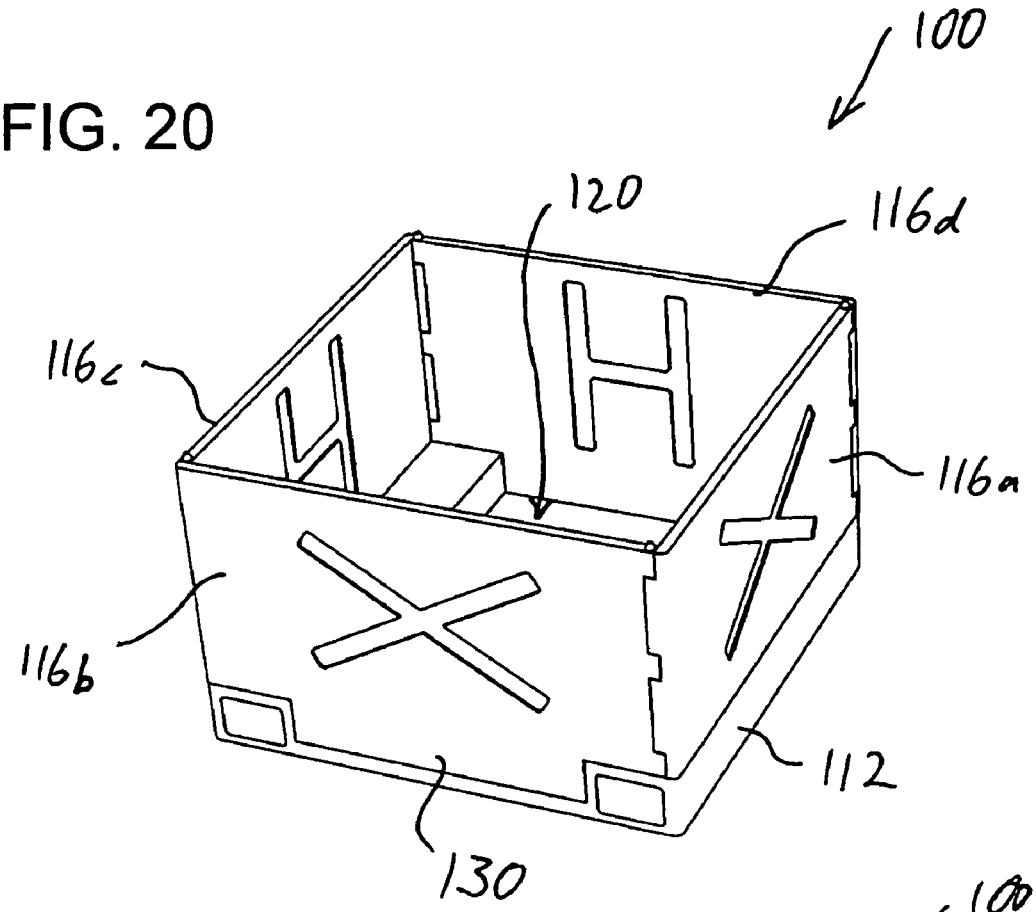
FIG. 20 is a schematic isometric view of a four-sided crate constructed from the base and sides of FIGS. 19A and 19B.
Figure 21:
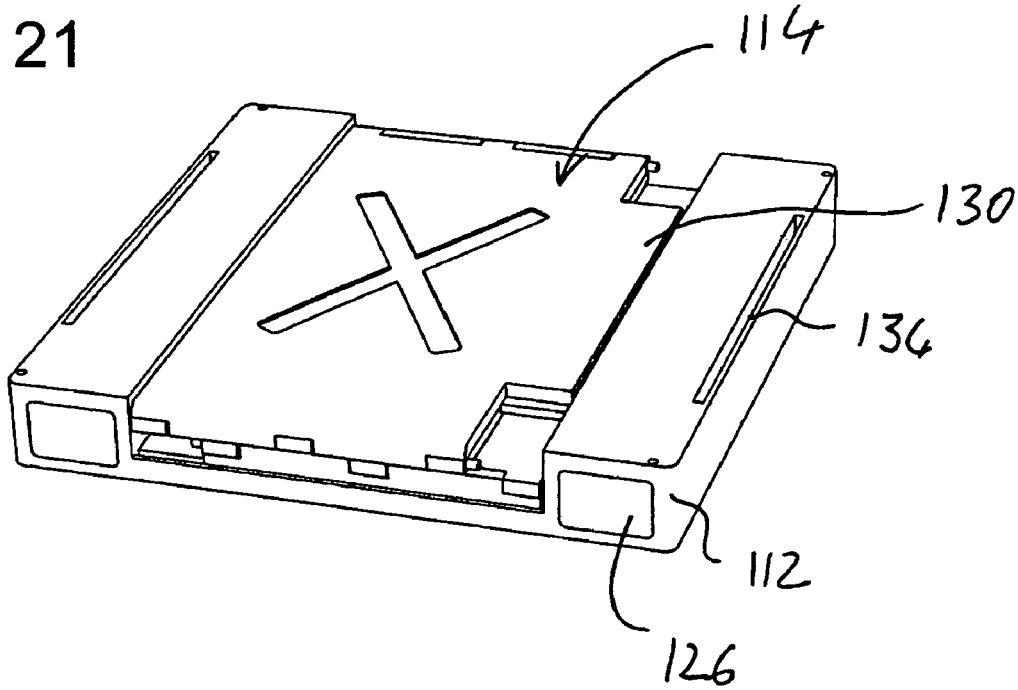
FIG. 21 is a schematic isometric view showing the sides of FIG. 19B received within a recess in the base of FIG. 19A.

Crate 100 differs from crate 10 primarily in that recess 120 is here an open-ended recess extending the entirety of length L. In order to ensure closure of the sides of the assembled crate, at least one pair of sides 116*b* and 116*d* each features a downwardly projecting tab 130 configured to substantially close an end of recess 120 when the side is engaged with base 112 as shown in FIG. 20. Most preferably, base 112 features an engagement indentation 132 (FIG. 8A) across each end of recess 120 with which downwardly projecting tabs 130 engage when assembled to provide mechanical support to the tabs.

As mentioned earlier, it is considered advantageous that the crates of the present invention employ four interchangeable sides, thereby allowing a user to assemble the crate with each side engaged along an arbitrarily chosen edge of the base. Parenthetically, it should be noted that the term "interchangeable" as used herein refers to sides having functionally equivalent features to the extent that inadvertent swapping of two sides does not significantly impact the function of the assembled crate. Interchangeability does not necessarily imply that the sides are identical or indistinguishable.

In this embodiment, interchangeability of the sides may be achieved by providing a pair of slots 134 extending parallel to length L and configured for receiving downwardly projecting tabs 130 of the sides deployed parallel to length L. The engagement of tabs 130 within slots 134 also adds structural strength to the assembled crate. In order to allow sides 116*a* and 116*c* to be located at the outer edge of base 112, tabs 130 are most preferably slightly thinner than the main upper portion of the sides and slightly set back from the plane of the outer surface of the side.

Clearly, in an alternative implementation (not shown), tabs 130 may have a thickness equal to that of the main upper portion of the sides, the tabs being received in a corresponding external recess formed in the external surfaces of the base parallel to the length L.

In all other respects, the structure and function of crate 100 will be understood by analogy to that of crate 10 described herein.

Figure 24A:
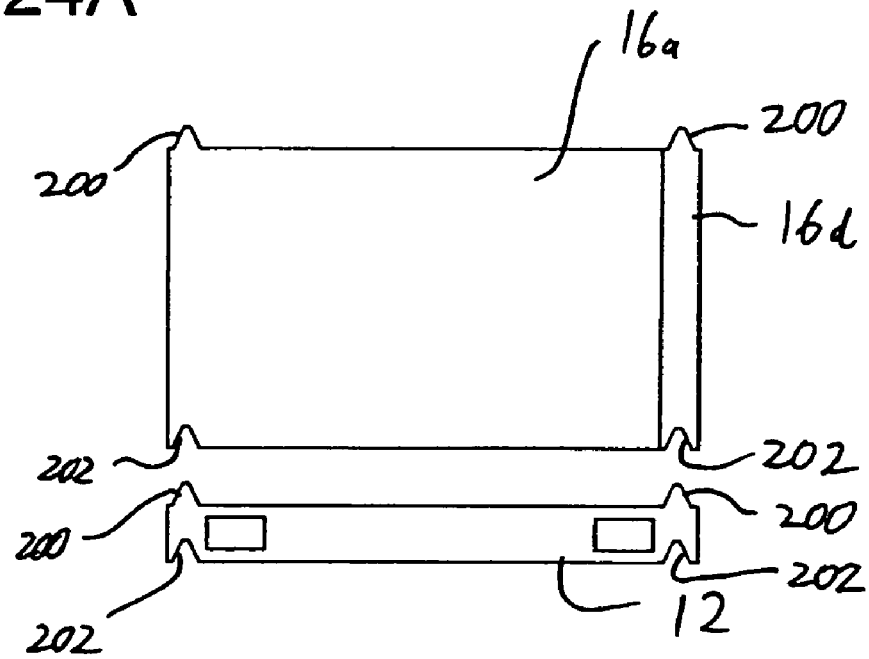
FIGS. 24A-24C are schematic cross-sectional views showing stacking features of the crates of the present invention prior to assembly, when assembled, and when in the knocked-down state, respectively.
Figure 24B:
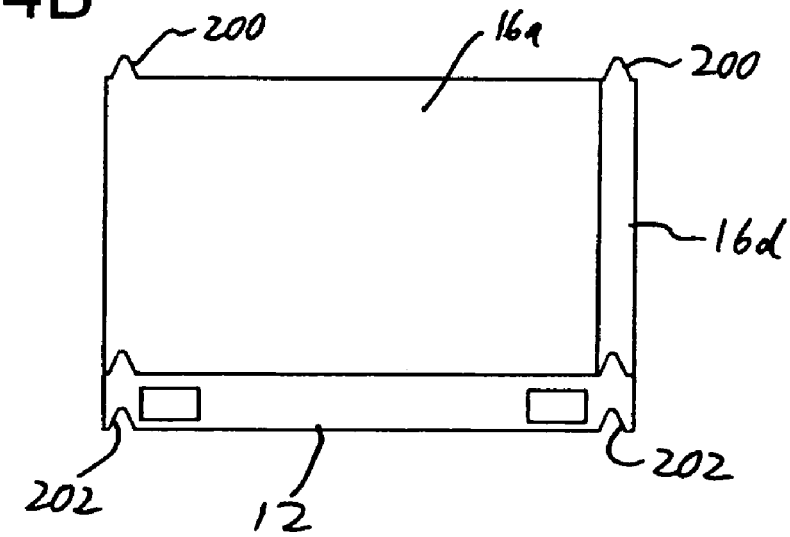
Figure 24C:
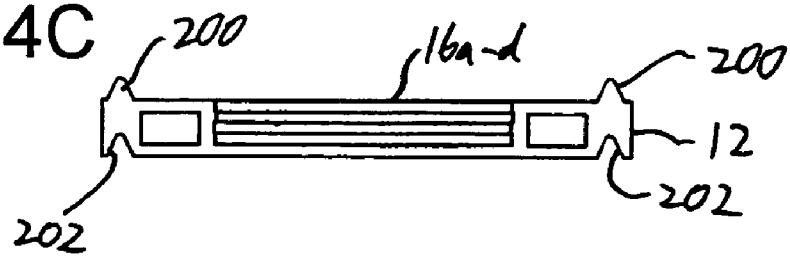

Referring now again generically to both embodiments of a crate according to the teachings of the present invention, the sides and base are preferably configured to allow stacking of the crate with other similar crates in both the assembled crate configuration and the knock-down compact configuration. To this end, the upper and lower edges of sides 16*a*, 16*b*, 16*c* and 16*d*, and upper and lower peripheral regions of base 112 are preferably formed with complementary alignment projections 200 and recesses 202 (FIG. 24A). Alignment projections 200 and recesses 202 are positioned and configured such that, when the sides are engaged with the base to form the four-sided crate (FIG. 24B), alignment projections 200 and recesses 202 on the upper edges of the sides and on the lower peripheral region of the base serve to align the four-sided crate with similar crates (not shown) placed above and below the crate, and when the sides are received within recess 20 (FIG. 24C), alignment projections 200 and recesses 202 on the upper and lower peripheral regions of the base serve to align the base with similar bases (not shown) placed above and below the base.

Figure 22:
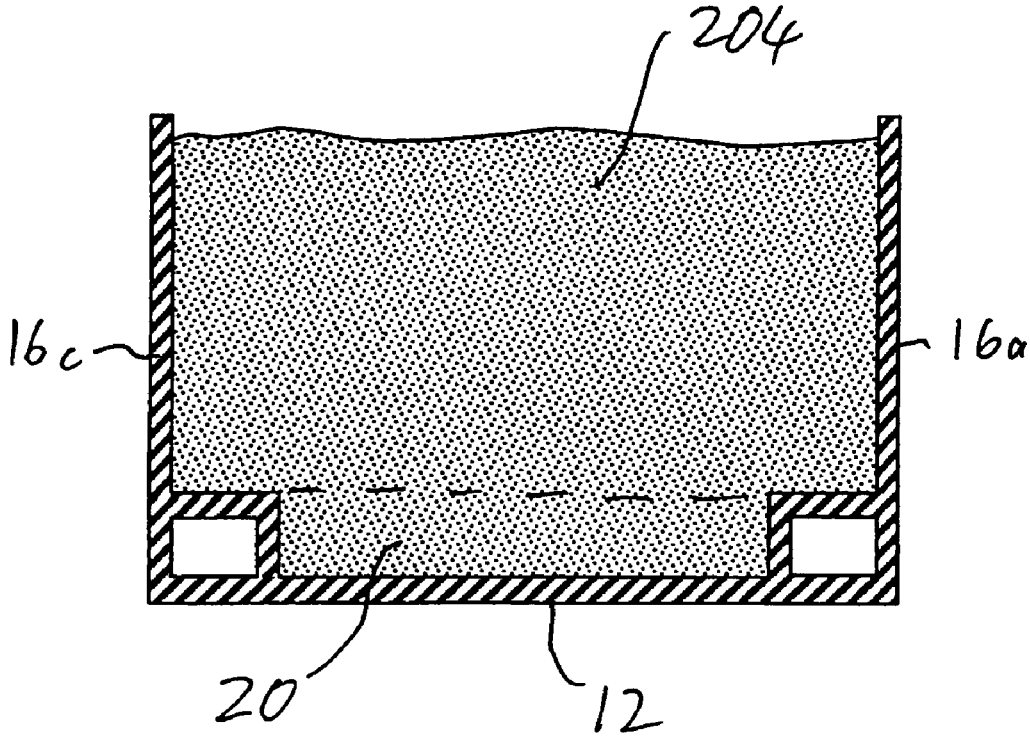
FIG. 22 is a schematic cross-sectional view of the crate of FIG. 3 or FIG. 20 in use filled with produce.
Figure 23:
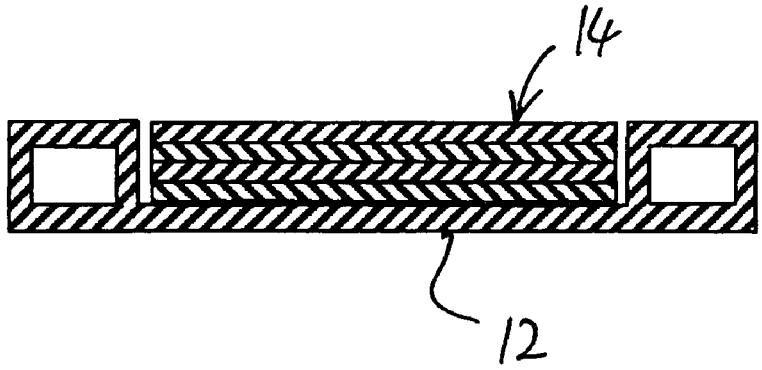
FIG. 23 is a schematic cross-sectional view similar to FIG. 22 showing the crate in its knocked-down configuration for return transport.

At this point, the use of crates 10 and 100 will be clearly understood. Specifically, the crate is deployed in its deployed "crate configuration" and loaded with produce at a loading location. It will be noted that, as shown in FIG. 22, at least part of the produce 204 lies within the elongated recess 20, thereby contributing to the total volume of produce which can be transported within the crate. Then, after transporting the produce in the crate to an unloading location, the produce is unloaded from the crate and the crate is disassembled and the walls stored in the recess to produce the "knock-down configuration" as shown in FIG. 23. The crate is then compact and conveniently handled, with the four sides located substantially within elongated recess 20, for transport to a next loading location. Most preferably, in a crate having alignment features as described with reference to FIGS. 24A-24C, the crate is stacked with other similar crates when in the crate configuration such that the alignment projections and recesses on the upper edges of the sides and on the lower peripheral region of the base serve to align the crate with the other similar crates placed above and below the crate, and is stacked when in the knock-down configuration with other similar crates such that the alignment projections and recesses on the upper and lower peripheral regions of the base serve to align the crate with the other similar crates placed above and below the crate.

It will be appreciated that the above descriptions are intended only to serve as examples, and that many other embodiments are possible within the scope of the present invention as defined in the appended claims.

What is claimed is:

1. A knock-down crate comprising:

(a) a base having a length, a breadth, and an upper surface that includes an elongated recess, said base including a pair of elongated channels extending parallel to said length such that a major part of said recess lies between said elongated channels, each of said channels having at least one open end for receiving tines of a forklift mechanism, said recess and said elongated channels being arranged such that a horizontal cross section through said base intersects said recess and said elongated channels;

(b) four side elements; and (c) a first mechanical linkage arrangement interconnecting said base and a first at least two of said sides, such that said four side elements are deployable in a crate configuration wherein said four side elements are interconnected with said base and each other to form a four-sided crate, said four side elements being further deployable in a knock-down configuration wherein said first mechanical linkage arrangement provides interconnected displacement of said first at least two of said side elements such that said first at least two of said side elements are received substantially within said elongated recess.

2. The knock-down crate of claim 1, wherein each of said four side elements is interconnected to said base.

3. The knock-down crate of claim 2, wherein a second at least two side elements are hingedly interconnected to said base by a second mechanical linkage arrangement.

4. The knock-down crate of claim 1, wherein said first at least two side elements are hingedly interconnected to said base by a hinge bracket that provides rotation about first and second axes of rotation, such that as each one of said first at least two side elements is folded inwardly, rotation about said first axis allows a bottom edge of each one of said first at least two side elements to move away from an edge of said length in order to reach said recess and rotation about said second axis allows each one of said first at least two sides to lie substantially parallel to said upper surface when received in said recess.

5. The knock-down crate of claim 1, wherein a plurality of said side elements include attachment features configured so as to disengagably attach adjacent side elements one to another when said four side elements are deployed in said crate configuration.

6. The knock-down crate of claim 1, wherein a second at least two side elements are configured such that when is said knock-down configuration each of said second at least two side elements folds such that each side of said second at least two side elements folds over no more than half of one of said length and said breadth.

7. The knock-down crate of claim 6, wherein at least one side of said second at least two side elements includes a foldable extension portion along a top region.

8. The knock-down crate of claim 1, wherein said length is substantially equal to said breadth.

9. The knock-down crate of claim 1, wherein said elongated recess is a closed-ended recess terminating at two end walls.

10. The knock-down crate of claim 9, wherein each of said four side elements has a length no greater than a length of said closed-ended recess.

11. A knock-down crate comprising:

(a) a base having a length, a breadth, and an upper surface that includes an elongated recess, said base including a pair of forklift tine engagement regions extending parallel to said length such that a major part of said recess lies between said forklift tine engagement regions, each of said forklift tine engagement regions having at least one open end for receiving tines of a forklift mechanism, said recess and said engagement regions being arranged such that a horizontal cross section through said base intersects said recess and said engagement regions;

(b) four side elements; and (c) a first mechanical linkage arrangement interconnecting said base and a first at least two of said sides, such that said four side elements are deployable in a crate configuration wherein said four side elements are interconnected with said base and each other to form a four-sided crate, said four side elements being further deployable in a knock-down configuration wherein said first mechanical linkage arrangement provides interconnected displacement of said first at least two of said side elements such that said first at least two of said side elements are received substantially within said elongated recess.

12. A knock-down crate comprising:

(a) a base having a length, a breadth, and an upper surface, said base being formed with a pair of elongated channels extending along said length for receiving tines of a forklift mechanism for lifting the crate;

(b) a first pair of sides for deployment parallel to said length; and (c) a second pair of sides for deployment parallel to said breadth, wherein said first and second pairs of sides are deployable in a crate configuration in which said first and second pairs of sides are mechanically linked to said base so as to define an internal volume, said first and second pairs of sides being further deployable in a reduced volume knock-down configuration, wherein said base features an elongated recess in said upper surface located between said pair of elongated channels and extending along substantially the entirety of said length such that a horizontal cross section through said base intersects said recess and said elongated channels, said recess contributing to an internal volume of said crate when said first and second pairs of sides assume said crate configuration, said recess receiving at least a major part of said first pair of sides in said knock-down configuration.

13. The knock-down crate of claim 12, wherein said first pair of sides are mechanically linked to said base so as to provide interconnected displacement of said first pair of sides from said crate configuration to said knock-down configuration.

14. The knock-down crate of claim 13, wherein both of said first and second pairs of sides are mechanically linked to said base throughout deployment from said crate configuration to said knock-down configuration.

* * * * *